US006087913A

United States Patent [19]

Castonguay et al.

[11] Patent Number: 6,087,913

[45] **Date of Patent: *Jul. 11, 2000**

[54] CIRCUIT BREAKER MECHANISM FOR A ROTARY CONTACT SYSTEM

[75] Inventors: Roger N. Castonguay, Terryville; Randall L. Greenberg, Granby; Dave S. Christensen, Sandy Hook, all of Conn.

[73] Assignee: General Electric Company, Schenectady, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/196,706

[22] Filed: Nov. 20, 1998

[51] Int. Cl.[7] ..... H01H 75/00

[52] U.S. Cl. ..... 335/16; 200/400; 218/7; 218/22

[58] Field of Search ..... 335/16, 147, 195, 335/8–10; 200/400, 401, 17 R; 218/22, 7, 14, 152, 153

[56] References Cited

U.S. PATENT DOCUMENTS

| | | | |
|---|---|---|---|
| D. 367,265 | 2/1996 | Yamagata et al. | D13/160 |
| 2,340,682 | 2/1944 | Powell | 200/147 |
| 2,719,203 | 9/1955 | Gelzheiser et al. | 200/144 |
| 2,937,254 | 5/1960 | Ericson | 200/114 |
| 3,158,717 | 11/1964 | Jencks et al. | 200/116 |

(List continued on next page.)

FOREIGN PATENT DOCUMENTS

| | | |
|---|---|---|
| 819 008 | 12/1974 | Belgium . |
| 897 691 | 1/1984 | Belgium . |
| 0 061 092 | 9/1982 | European Pat. Off. . |
| 0 064 906 | 11/1982 | European Pat. Off. . |
| 0 066 486 | 12/1982 | European Pat. Off. . |
| 0 076 719 | 4/1983 | European Pat. Off. . |
| 0 117 094 | 8/1984 | European Pat. Off. . |
| 0 140 761 | 5/1985 | European Pat. Off. . |
| 0 174 904 | 3/1986 | European Pat. Off. . |
| 0 196 241 | 10/1986 | European Pat. Off. . |
| 0 224 396 | 6/1987 | European Pat. Off. . |
| 0 235 479 | 9/1987 | European Pat. Off. . |
| 0 239 460 | 9/1987 | European Pat. Off. . |
| 0 258 090 | 3/1988 | European Pat. Off. . |
| 0 264 313 | 4/1988 | European Pat. Off. . |
| 0 264 314 | 4/1988 | European Pat. Off. . |
| 0 283 189 | 9/1988 | European Pat. Off. . |
| 0 283 358 | 9/1988 | European Pat. Off. . |
| 0 291 374 | 11/1988 | European Pat. Off. . |
| 0 295 155 | 12/1988 | European Pat. Off. . |
| 0 295 158 | 12/1988 | European Pat. Off. . |
| 0 309 923 | 4/1989 | European Pat. Off. . |
| 0 313 106 | 4/1989 | European Pat. Off. . |
| 0 313 422 | 4/1989 | European Pat. Off. . |
| 0 314 540 | 5/1989 | European Pat. Off. . |
| 0 331 586 | 9/1989 | European Pat. Off. . |
| 0 337 900 | 10/1989 | European Pat. Off. . |
| 0 342 133 | 11/1989 | European Pat. Off. . |
| 0 367 690 | 5/1990 | European Pat. Off. . |
| 0 371 887 | 6/1990 | European Pat. Off. . |
| 0 375 568 | 6/1990 | European Pat. Off. . |
| 0 394 144 | 10/1990 | European Pat. Off. . |
| 0 394 922 | 10/1990 | European Pat. Off. . |
| 0 399 282 | 11/1990 | European Pat. Off. . |
| 0 407 310 | 1/1991 | European Pat. Off. . |
| 0 452 230 | 10/1991 | European Pat. Off. . |
| 0 555 158 | 8/1993 | European Pat. Off. . |

(List continued on next page.)

*Primary Examiner*—Lincoln Donovan
*Assistant Examiner*—Tuyen Nguyen
*Attorney, Agent, or Firm*—Carl B. Horton; Damian G. Wasserbauer; Dave S. Christensen

[57] ABSTRACT

A rotary contact circuit breaker employs a crank to couple a switching mechanism to the rotary contact pole structure. The use of a crank allows for the mechanism and pole structure the individually optimized without effecting the performance of the other. In particular the crank allows for a mechanism that is able to achieve maximum torque delivery to the pole structure.

14 Claims, 5 Drawing Sheets

U.S. PATENT DOCUMENTS

| | | | |
|---|---|---|---|
| 3,162,739 | 12/1964 | Klein et al. | 200/88 |
| 3,197,582 | 7/1965 | Norden | 200/50 |
| 3,307,002 | 2/1967 | Cooper | 200/116 |
| 3,517,356 | 6/1970 | Hanafusa | 335/16 |
| 3,631,369 | 12/1971 | Menocal | 337/110 |
| 3,803,455 | 4/1974 | Willard | 317/33 SC |
| 3,883,781 | 5/1975 | Cotton | 317/14 R |
| 4,129,762 | 12/1978 | Bruchet | 200/153 G |
| 4,144,513 | 3/1979 | Shafer et al. | 335/46 |
| 4,158,119 | 6/1979 | Krakik | 200/240 |
| 4,165,453 | 8/1979 | Hennemann | 200/153 G |
| 4,166,988 | 9/1979 | Ciarcia et al. | 335/9 |
| 4,220,934 | 9/1980 | Wafer et al. | 335/16 |
| 4,255,732 | 3/1981 | Wafer et al. | 335/16 |
| 4,259,651 | 3/1981 | Yamat | 335/16 |
| 4,263,492 | 4/1981 | Maier et al. | 200/288 |
| 4,276,527 | 6/1981 | Gerbert-Gaillard et al. | 335/39 |
| 4,297,663 | 10/1981 | Seymour et al. | 335/20 |
| 4,301,342 | 11/1981 | Castonguay et al. | 200/153 SC |
| 4,360,852 | 11/1982 | Gilmore | 361/98 |
| 4,368,444 | 1/1983 | Preuss et al. | 335/166 |
| 4,375,021 | 2/1983 | Pardini et al. | 200/147 B |
| 4,375,022 | 2/1983 | Daussin et al. | 200/148 R |
| 4,376,270 | 3/1983 | Staffen | 335/21 |
| 4,383,146 | 5/1983 | Bur | 200/17 R |
| 4,392,036 | 7/1983 | Troebel et al. | 200/322 |
| 4,393,283 | 7/1983 | Masuda | 200/51.09 |
| 4,401,872 | 8/1983 | Boichot-Castagne et al. | 200/153 G |
| 4,409,573 | 10/1983 | DiMarco et al. | 335/16 |
| 4,435,690 | 3/1984 | Link et al. | 335/37 |
| 4,467,297 | 8/1984 | Boichot-Castagne et al. | 335/8 |
| 4,468,645 | 8/1984 | Gerbert-Gaillard et al. | 335/42 |
| 4,470,027 | 9/1984 | Link et al. | 335/16 |
| 4,479,143 | 10/1984 | Watanabe et al. | 358/44 |
| 4,488,133 | 12/1984 | McClellan et al. | 335/16 |
| 4,492,941 | 1/1985 | Nagel | 335/13 |
| 4,541,032 | 9/1985 | Schwab | 361/331 |
| 4,546,224 | 10/1985 | Mostosi | 200/153 G |
| 4,550,360 | 10/1985 | Dougherty | 361/93 |
| 4,562,419 | 12/1985 | Preuss et al. | 335/195 |
| 4,589,052 | 5/1986 | Dougherty | 361/94 |
| 4,595,812 | 6/1986 | Tamaru et al. | 200/307 |
| 4,611,187 | 9/1986 | Banfi | 335/16 |
| 4,612,430 | 9/1986 | Sloan et al. | 200/327 |
| 4,616,198 | 10/1986 | Pardini | 335/16 |
| 4,622,444 | 11/1986 | Kandatsu et al. | 200/303 |
| 4,631,625 | 12/1986 | Alexander et al. | 361/94 |
| 4,642,431 | 2/1987 | Tedesco et al. | 200/153 G |
| 4,644,438 | 2/1987 | Puccinelli et al. | 361/75 |
| 4,649,247 | 3/1987 | Preuss et al. | 200/244 |
| 4,658,322 | 4/1987 | Rivera | 361/37 |
| 4,672,501 | 6/1987 | Bilac et al. | 361/96 |
| 4,675,481 | 6/1987 | Markowski et al. | 200/144 R |
| 4,682,264 | 7/1987 | Demeyer | 361/96 |
| 4,689,712 | 8/1987 | Demeyer | 361/96 |
| 4,694,373 | 9/1987 | Demeyer | 361/96 |
| 4,710,845 | 12/1987 | Demeyer | 361/96 |
| 4,717,985 | 1/1988 | Demeyer | 361/96 |
| 4,733,211 | 3/1988 | Castonguay et al. | 335/192 |
| 4,733,321 | 3/1988 | Lindeperg | 361/96 |
| 4,764,650 | 8/1988 | Bur et al. | 200/153 G |
| 4,768,007 | 8/1988 | Mertz et al. | 335/202 |
| 4,780,786 | 10/1988 | Weynachter et al. | 361/87 |
| 4,831,221 | 5/1989 | Yu et al. | 200/553 |
| 4,870,531 | 9/1989 | Danek | 361/93 |
| 4,883,931 | 11/1989 | Batteux et al. | 200/148 R |
| 4,884,047 | 11/1989 | Baginski et al. | 335/10 |
| 4,884,164 | 11/1989 | Dziura et al. | 361/97 |
| 4,900,882 | 2/1990 | Bernard et al. | 200/147 R |
| 4,910,485 | 3/1990 | Bolongeat-Mobleu et al. | 335/195 |
| 4,914,541 | 4/1990 | Tripodi et al. | 361/94 |
| 4,916,420 | 4/1990 | Bartolo et al. | 335/172 |
| 4,916,421 | 4/1990 | Pardini et al. | 335/185 |
| 4,926,282 | 5/1990 | McGhie | 361/102 |
| 4,935,590 | 6/1990 | Malkin et al. | 20/148 A |
| 4,937,706 | 6/1990 | Schueller et al. | 361/396 |
| 4,939,492 | 7/1990 | Raso et al. | 335/42 |
| 4,943,691 | 7/1990 | Mertz et al. | 200/151 |
| 4,943,888 | 7/1990 | Jacob et al. | 361/96 |
| 4,950,855 | 8/1990 | Bolonegeat-Mobleu et al. | 200/148 A |
| 4,951,019 | 8/1990 | Gula | 335/166 |
| 4,952,897 | 8/1990 | Barnel et al. | 335/147 |
| 4,958,135 | 9/1990 | Baginski et al. | 335/8 |
| 4,965,543 | 10/1990 | Batteux | 335/174 |
| 4,983,788 | 1/1991 | Pardini | 200/16 R |
| 5,001,313 | 3/1991 | Leclerq et al. | 200/148 B |
| 5,004,878 | 4/1991 | Seymour et al. | 200/144 R |
| 5,029,301 | 7/1991 | Nebon et al. | 335/16 |
| 5,030,804 | 7/1991 | Abri | 200/323 |
| 5,057,655 | 10/1991 | Kersusan et al. | 200/148 B |
| 5,077,627 | 12/1991 | Fraisse | 361/93 |
| 5,083,081 | 1/1992 | Barrault et al. | 324/126 |
| 5,095,183 | 3/1992 | Raphard et al. | 200/148 A |
| 5,103,198 | 4/1992 | Morel et al. | 335/6 |
| 5,115,371 | 5/1992 | Tripodi | 361/106 |
| 5,120,921 | 6/1992 | DiMarco et al. | 200/401 |
| 5,132,865 | 7/1992 | Mertz et al. | 361/6 |
| 5,138,121 | 8/1992 | Streich et al. | 200/293 |
| 5,140,115 | 8/1992 | Morris | 200/308 |
| 5,153,802 | 10/1992 | Mertz et al. | 361/18 |
| 5,155,315 | 10/1992 | Malkin et al. | 20/148 R |
| 5,166,483 | 11/1992 | Kersusan et al. | 200/144 A |
| 5,172,087 | 12/1992 | Castonguay et al. | 335/160 |
| 5,178,504 | 1/1993 | Falchi | 411/553 |
| 5,184,717 | 2/1993 | Chou et al. | 200/401 |
| 5,187,339 | 2/1993 | Lissandrin | 200/148 F |
| 5,198,956 | 3/1993 | Dvorak | 361/106 |
| 5,200,724 | 4/1993 | Gula et al. | 335/166 |
| 5,210,385 | 5/1993 | Morel et al. | 200/146 R |
| 5,239,150 | 8/1993 | Bolongeat-Mobleu et al. | 200/148 R |
| 5,260,533 | 11/1993 | Livesey et al. | 200/401 |
| 5,262,744 | 11/1993 | Arnold et al. | 335/8 |
| 5,280,144 | 1/1994 | Bolongeat-Mobleu et al. | 200/148 R |
| 5,281,776 | 1/1994 | Morel et al. | 218/152 |
| 5,296,660 | 3/1994 | Morel et al. | 200/146 R |
| 5,296,664 | 3/1994 | Crookston et al. | 200/401 |
| 5,298,874 | 3/1994 | Morel et al. | 335/8 |
| 5,300,907 | 4/1994 | Nereau et al. | 335/172 |
| 5,310,971 | 5/1994 | Vial et al. | 200/244 |
| 5,313,180 | 5/1994 | Vial et al. | 335/16 |
| 5,317,471 | 5/1994 | Izoard et al. | 361/105 |
| 5,331,500 | 7/1994 | Corcoles et al. | 361/93 |
| 5,334,808 | 8/1994 | Bur et al. | 200/50 |
| 5,341,191 | 8/1994 | Crookston et al. | 335/16 |
| 5,347,096 | 9/1994 | Bolongeat-Mobleu et al. | 200/148 B |
| 5,347,097 | 9/1994 | Bolongeat-Mobleu et al. | 200/148 B |
| 5,350,892 | 9/1994 | Rozier | 200/144 B |
| 5,357,066 | 10/1994 | Morel et al. | 200/17 R |
| 5,357,068 | 10/1994 | Rozier | 200/148 R |
| 5,357,394 | 10/1994 | Piney | 361/72 |
| 5,361,052 | 11/1994 | Ferullo et al. | 335/172 |
| 5,373,130 | 12/1994 | Barrault et al. | 200/147 R |
| 5,379,013 | 1/1995 | Coudert | 335/17 |
| 5,424,701 | 6/1995 | Castonguary et al. | 335/172 |
| 5,438,176 | 8/1995 | Bonnardel et al. | 200/400 |
| 5,440,088 | 8/1995 | Coudert et al. | 200/303 |
| 5,449,871 | 9/1995 | Batteux et al. | 200/401 |
| 5,450,048 | 9/1995 | Leger et al. | 335/132 |
| 5,451,729 | 9/1995 | Onderka et al. | 200/18 |
| 5,457,295 | 10/1995 | Tanibe et al. | 200/293 |
| 5,467,069 | 11/1995 | Payet-Burin et al. | 335/42 |
| 5,469,121 | 11/1995 | Payet-Burin | 335/16 |

| | | | |
|---|---|---|---|
| 5,475,558 | 12/1995 | Barjonnet et al. | 361/64 |
| 5,477,016 | 12/1995 | Baginski et al. | 200/43.11 |
| 5,479,143 | 12/1995 | Payet-Burin | 335/202 |
| 5,483,212 | 1/1996 | Lankuttis et al. | 335/132 |
| 5,485,343 | 1/1996 | Santos et al. | 361/115 |
| 5,493,083 | 2/1996 | Olivier | 200/17 R |
| 5,504,284 | 4/1996 | Lazareth et al. | 200/50 R |
| 5,504,290 | 4/1996 | Baginski et al. | 200/401 |
| 5,510,761 | 4/1996 | Boder et al. | 335/172 |
| 5,512,720 | 4/1996 | Coudert et al. | 200/400 |
| 5,515,018 | 5/1996 | DiMarco et al. | 335/16 |
| 5,519,561 | 5/1996 | Mrenna et al. | 361/105 |
| 5,534,674 | 7/1996 | Steffens | 218/154 |
| 5,534,832 | 7/1996 | Duchemin et al. | 335/16 |
| 5,534,835 | 7/1996 | McColloch et al. | 335/172 |
| 5,534,840 | 7/1996 | Cuingnet | 337/1 |
| 5,539,168 | 7/1996 | Linzenich | 200/303 |
| 5,543,595 | 8/1996 | Mader et al. | 200/401 |
| 5,552,755 | 9/1996 | Fello et al. | 335/18 |
| 5,581,219 | 12/1996 | Nozawa et al. | 335/132 |
| 5,604,656 | 2/1997 | Derrick et al. | 361/187 |
| 5,608,367 | 3/1997 | Zoller et al. | 335/132 |
| 5,784,233 | 7/1998 | Bastard et al. | 361/36 |

FOREIGN PATENT DOCUMENTS

| | | |
|---|---|---|
| 0 567 416 | 10/1993 | European Pat. Off. . |
| 0 595 730 | 5/1994 | European Pat. Off. . |
| 0 619 591 | 10/1994 | European Pat. Off. . |
| 0 665 569 | 8/1995 | European Pat. Off. . |
| 0 700 140 | 3/1996 | European Pat. Off. . |
| 2 410 353 | 6/1979 | France . |
| 2 512 582 | 3/1983 | France . |
| 2 553 943 | 4/1985 | France . |
| 2 592 998 | 7/1987 | France . |
| 2 682 531 | 4/1993 | France . |
| 2 697 670 | 5/1994 | France . |
| 2 699 324 | 6/1994 | France . |
| 2 714 771 | 7/1995 | France . |
| 30 47 360 | 6/1882 | Germany . |
| 708972 | 8/1941 | Germany . |
| 12 27 978 | 11/1966 | Germany . |
| 38 02 184 | 8/1989 | Germany . |
| 38 43 277 | 6/1990 | Germany . |
| 44 19 240 | 1/1995 | Germany . |
| 1 227 978 | 4/1994 | Russian Federation . |
| 2 233 155 | 1/1991 | United Kingdom . |
| 92/00598 | 1/1992 | WIPO . |
| 92/05649 | 4/1992 | WIPO . |
| 94/00901 | 1/1994 | WIPO . |

CIRCUIT BREAKER MECHANISM FOR A ROTARY CONTACT SYSTEM

FIELD OF INVENTION

The present invention is directed to mechanism for a molded case circuit breaker capable of switching a rotary contact structure between on, off and tripped positions.

BACKGROUND OF THE INVENTION

The present invention is directed to a molded case circuit breaker having a mechanism for switching a rotary contact system between on, off and tripped positions.

U.S. Pat. No. 5,281,776 ('776) describes a molded case circuit breaker having a toggle type mechanism for switching a rotary contact system. This mechanism utilizes a lower linkage that directly attaches to a drive shaft which extends through and rotates the contact system, as is shown in FIG. 1. A crank attached to the same drive pin is used to drive another pin that also extends through the contact system. Since the drive shaft passes through the contact system, optimum positioning of this shaft may not be possible which may cause geometric constraints on how much force can be transferred from the switching mechanism to the rotor. This often limits the performance level that a circuit breaker which uses the '776 switching mechanism is able to achieve.

Therefore, it is desirable to optimize the switching mechanism to transmit an increased amount of force to a rotary contact system.

It is also considered desirable in conjunction with the improved switching mechanism to describe an interface between the mechanism and the contact system that allows for flexibility in the placement and design of the mechanism.

SUMMARY OF INVENTION

In accordance with the present invention a circuit breaker mechanism is provided that comprises a side frame having a cradle attached thereto. A toggle linkage consisting an upper link having a first and second end attaches to the cradle and a lower link attached to the upper link second end by a spring spindle. A crank member attached to the side frame attaches to the lower link. The crank provides the output torque generated by the mechanism.

Also in accordance with the present invention, a circuit breaker is provided which utilizes the switching mechanism if the present invention having a base, cover and handle operatively connected to a crank. This the preferred embodiment, a pair of opposing side frame attaches to the base and each provides for amounting of a cradle which is movable between a latch and tripped position. A toggle linkage consisting of an upper link having a first and second end attaches to said cradle proximate to the upper link first end. The upper link second end attaches to a lower link first end. The lower link has a second end which attaches to the crank. The crank is pivotally attached to the opposing side frames and has a first end attached to the lower link and a second end coupled with the drive pin. The drive pin extends through a rotor assembly. The rotor assembly is movable between a closed and open position.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF PREFERRED EMBODIMENT

Figure 1:
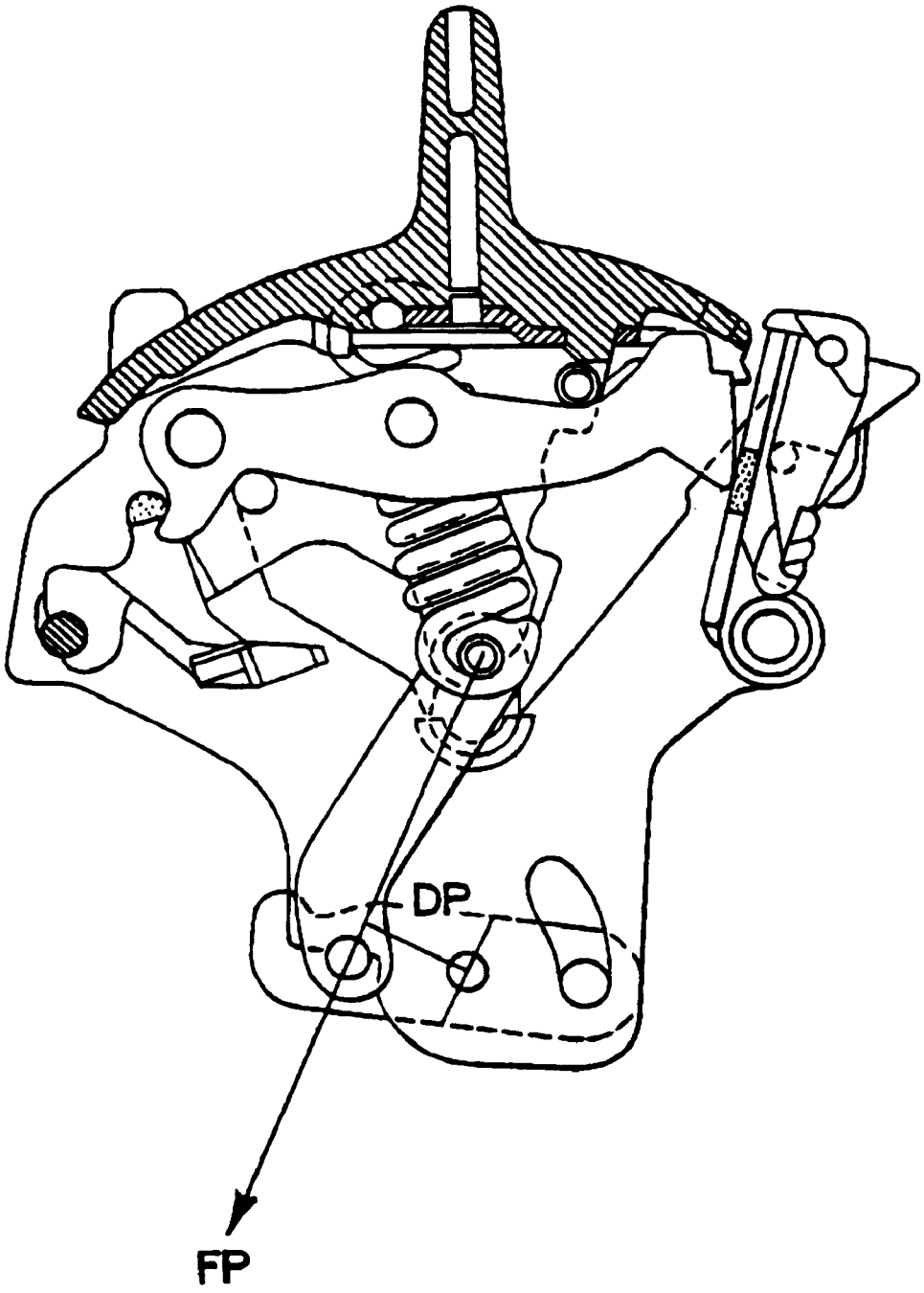
FIG. 1 (PRIOR ART)
FIG. 1 is a cross-sectional view of a prior art mechanism in the closed position.
Figure 2:
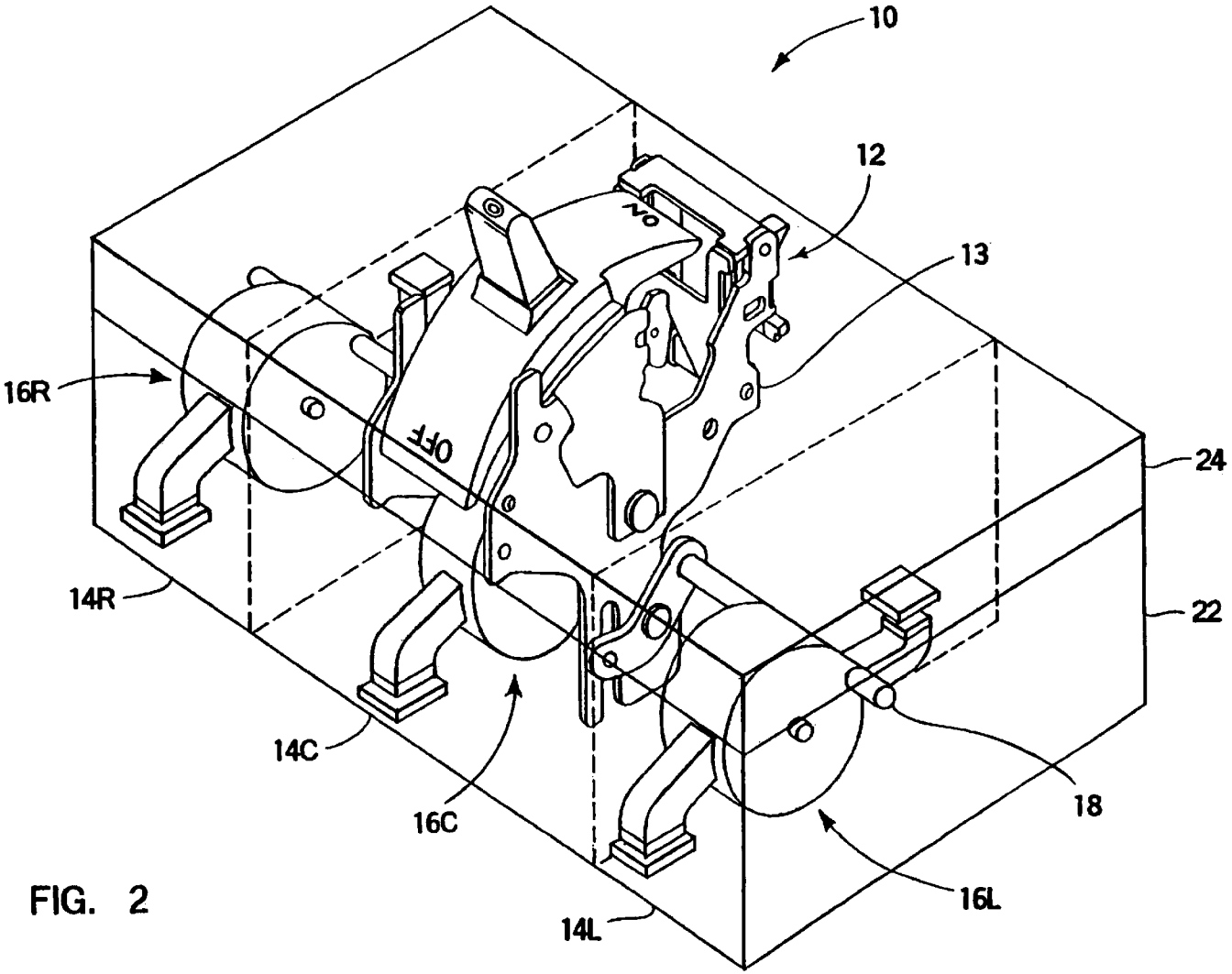
FIG. 2 is a top perspective view of a circuit breaker in accordance with the present invention.

Referring now to FIG. 2,the circuit breaker 10 in accordance with the present invention is comprised of a base 22 and a cover 24. Enclosed within the base 22 and cover 24 are three poles 14C, 14L, 14R each corresponding to a respective phase in an electrical circuit. Each pole 14C, 14L, 14R contains a rotary contact assembly 16C, 16L and 16R respectively, capable of carrying and interrupting electrical current. A drive shaft 18 connects the three poles 14C, 14L, 14R.

In addition, the center pole 14C is straddled by a mechanism assembly 12. The mechanism 12 connects to the poles 14C, 14L, 14R by the drive shaft 18. The poles 14C, 14L, 14R are operable to move between three positions open, closed, or tripped in response to operation of the mechanism 12.

Figure 3:
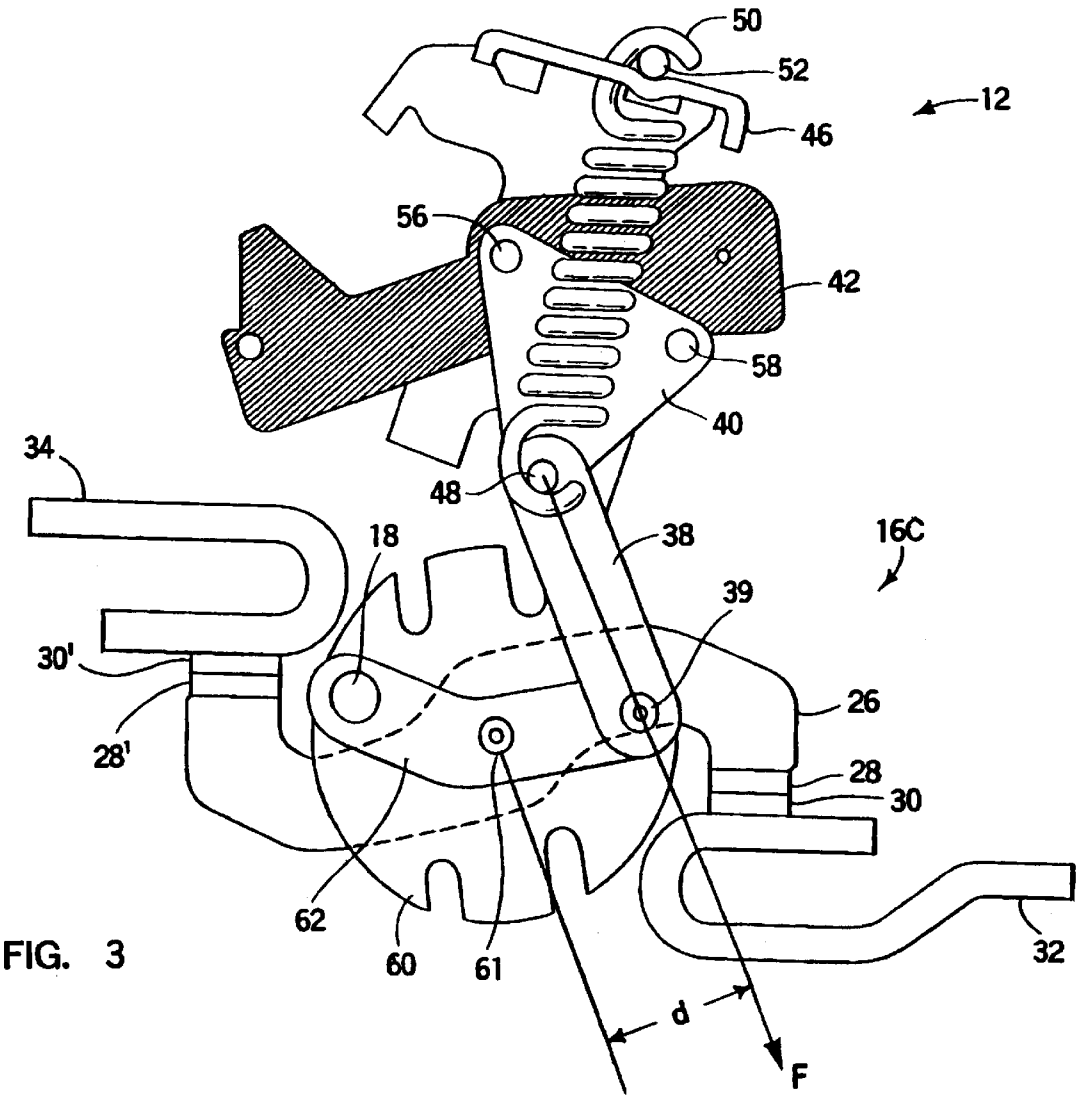
FIG. 3 is a front plan view of the elements of the present invention as illustrated in FIG. 2 in the CLOSED position.

As is seen in FIG. 3, each pole 14 is made up of a rotor 60 housing a contact arm 26, and a pair of movable contacts are 28, 28'. The movable contacts 28,28' mate with the pair of stationary contacts 30, 30' when the mechanism is in the CLOSED position shown. The stationary contacts 30, 30' are brazed or welded to a load strap 32 and line strap 34 respectively. The crank 62 connects the mechanism 12 to the rotor assembly 16C. The crank 62 pivots about the pin 61 which is assembled on the side frames 13. It should be appreciated that the rotor assemblies 16R, 16L may be identical to rotor assembly 16C. The operation of the rotor assembly 16C operates substantially the same as that described in co-pending U.S. patent application Ser. No. 09/087,038 filed May 29, 1998 which is incorporated herein by reference.

Mechanism 12 consists of a lower link 38 connected to the crank 62 by connector pin 39. The opposite end of the lower link 38 from the crank is connected to an upper link 40 by a spring spindle 48. The upper link 40 in turn is connected to cradle 42 by pin 56, to which is attached to a latch mechanism (not shown). The mechanism spring 50 is connected between the spring spindle 48 and a pin 52 in handle 46. The mechanism 12 is prevented from further counterclockwise rotation when the pin 58 attached to the upper link 40 comes into contact with the cradle 42.

The amount of torque that can be generated by the mechanism 12 is determined by the amount force F transferred from mechanism spring 50 through the lower link 38 and the moment arm. The moment arm is shown in FIG. 3 as the perpendicular distance d. The perpendicular distance d is the length of a perpendicular line from the crank pivot 61 to the line of action of the force F. Since torque is the product of the force F times the distance d, it should be apparent that for a given mechanism, the greater the distance d the more torque is generated. This distance d and thus the torque will be maximized when the distance d is coincident with the connecting pin 39. In the present invention, the pin 39 only connects the lower link 38 to the crank 62. It should be noted that in prior art mechanisms, the pin 39 was also the drive pin that extended through and connected all the rotors.

The components of the rotor assembly 16C often do not allow the drive pin to be placed in this optimal position. For example, as seen in FIG. 3, if the pin 39 is used as the drive shaft to connect all the rotor assemblies, then it would need to pass directly through the contact arm 26. Thus, if an optimized mechanism arrangement is desired, the lower link 38 needs to be decoupled from the drive shaft and the rotor assembly 16C. The present invention accomplishes this by attaching the lower link 38 to a crank 62 which in turn transmits the force to the drive shaft 18. The drive shaft 18 can then be positioned anywhere on the rotor without effecting the amount of torque the mechanism can create. By using the crank 62, either the rotor assembly 16C, or the mechanism assembly 12 may be optimized without compromising the performance of the other, thus allowing for the maximum amount of flexibility in the design of the circuit breaker while still maintaining optimized subassemblies.

Figure 4:
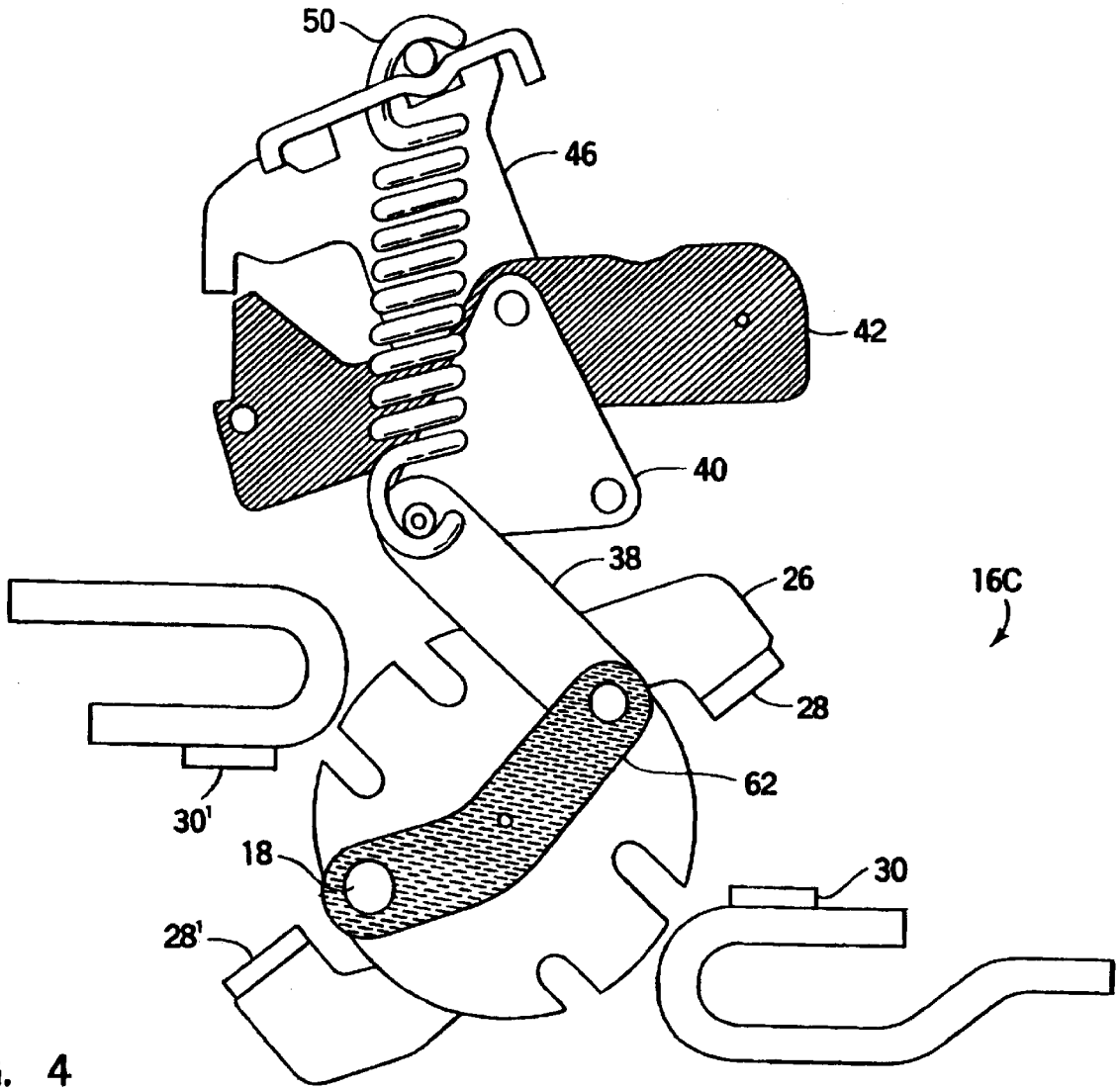
FIG. 4 is a front plan view of the elements of the present invention as illustrated in FIG. 2 in the OPEN position.
Figure 5:
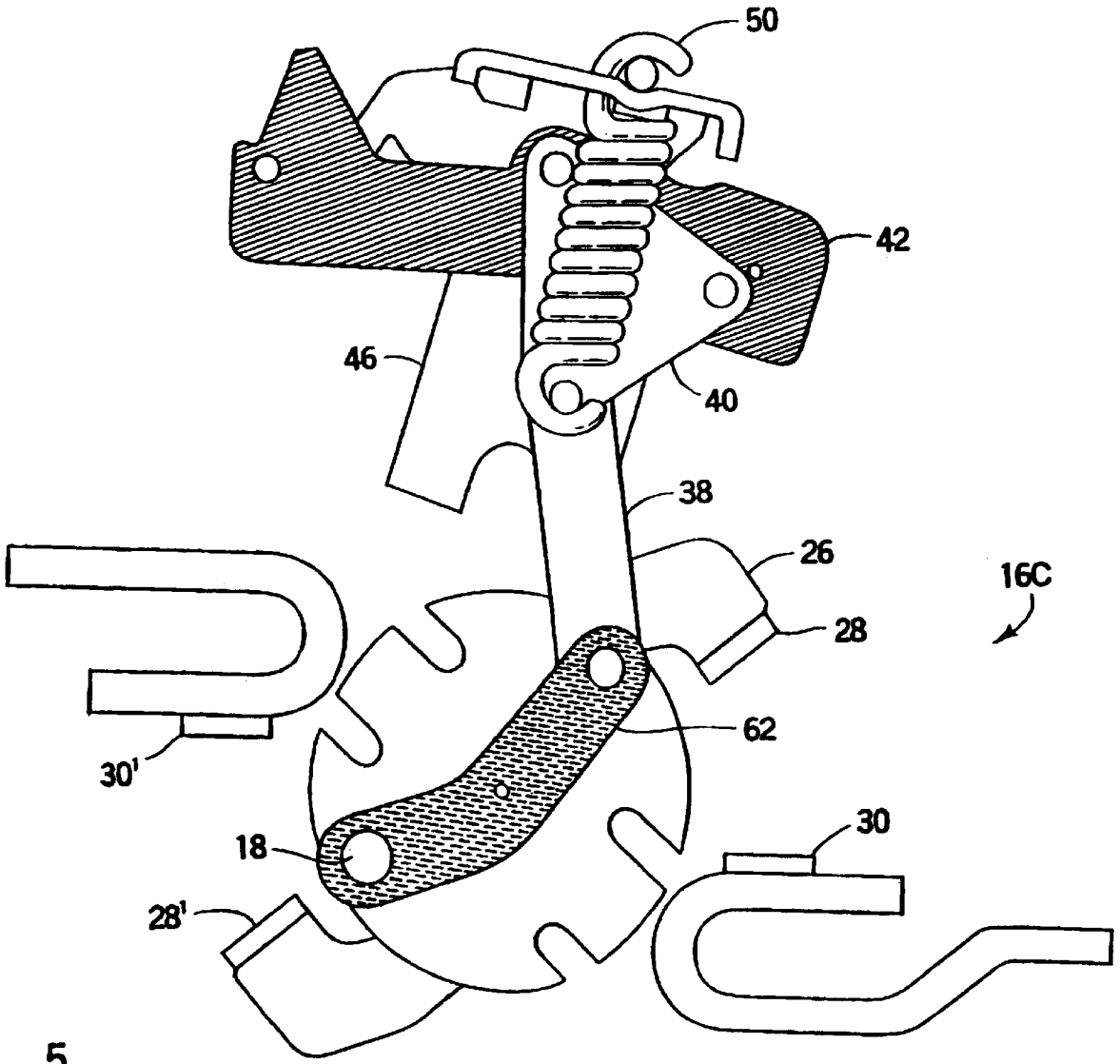
FIG. 5 is a front plan view of the elements of the present invention as illustrated in FIG. 2 in the TRIPPED position.

Referring to FIG. 4, under normal switching operation, the handle 46, is rotated counter-clockwise to switch the circuit breaker 10 from ON to OFF. As the handle 46 is rotated, the line-of-action of the spring 50 will move from the right side to the left side of the pivot 56. This movement "over-centers" the mechanism 12 and the force stored in the spring causes the mechanism 12 to open the rotor assemblies 16C, 16R, 16L. This opening movement separates the movable contacts 28, 28' from the stationary contacts 30, 30' thereby preventing any flow of current through the circuit breaker 10.

When an abnormal condition is detected by a circuit breaker trip unit (not shown), the latching mechanism (not shown) is released allowing the cradle 42 to rotate in a clockwise direction. The latch and trip unit are similar to U.S. Pat. No. 4,789,8;48 which is incorporated herein by reference. The resulting movement of the cradle 42 causes the rotor assembly 16C via the upper link 40 and the lower link 38 to rotate separating the movable contacts 28,28' from the stationary contacts 30,30'. The separation of the contacts stops the flow of current through the circuit breaker 10.

Although a preferred embodiment of this invention has been described, many variations and modifications will now be apparent to those skilled in the art, and it is therefore preferred that the instant invention be limited not by the specific disclosure herein but only by the following claims.

We claim:

1. A mechanism for a multipole circuit breaker comprising:

at least one side frame; cradle attached to said side frame, said cradle movable between a latched and tripped position;

a toggle linkage formed by an upper link member having a first and second ends and rotatably attached at said first end to said cradle and a lower linkage having a first and second ends, said lower linkage first end being secured to said upper linkage second end by a spring spindle;

a crank member being attached for rotation to said side frame and having a first and second ends, said crank first end being pivotally attached to said lower linkage second end by a pin and is attached to said side frame by a pivot;

at least one rotary contact assembly mounted for rotation proximate to said crank, said contact assembly including a rotor movable between closed and open position and having an opposing first and second side faces, a contact arm having a first and second ends, said contact arm mounted for rotation to said rotor and at least one contact mounted to said contact arm on one of said ends;

a handle lever attached for rotation to said side frame;

a spring attached between said toggle linkage spring spindle and said handle lever;

said crank first end is arranged such that a line between the center of said crank pivot and the center of said pin is perpendicular to a line of force created by said spring and transmitted through said lower link when said rotor is in the closed position.

2. The mechanism of claim 1 wherein:

said sector assembly has a first orifice extending through said rotor first and second side faces.

3. The mechanism of claim 2 further comprising:

a drive shaft extending th rough said rotary contact assembly orifice and coupled to said crank second end.

4. The mechanism of claim 3 wherein:

said at least one side frame consists of a first and second parallel side frames, said side frames being positioned on either side of said rotor assembly;

said crank is attached to said first side frame.

5. The mechanism of claim 4 further comprising:

a second crank connected to said second side frame;

a second upper link attached to said cradle;

a second lower link having a first and second end with said first end attached to said second upper link, said lower link second end attached to said second crank.

6. The mechanism of claim 5 wherein:

said second crank consisting of a first and second end where said first end is attached to said second lower link and said crank second end is coupled with said drive shaft.

7. A multipole circuit breaker comprising:

a base;

a side frame mounted to said base;

a cradle attached for rotation to said side frame, said cradle movable between a latched and tripped positions;

a toggle linkage formed by an upper linkage member having a first and second ends and rotatably attached at said first end to said cradle and a lower linkage member having a first and second ends, said first end being secured to said upper linkage second end by a spring spindle;

a crank member being attached for rotation to said side frame and having a first and second ends, said crank first end being pivotally attached to said side frame by a pivot, said crank is attached to said lower link second end by a pin;

a first rotary contact assembly mounted for rotation within said base proximate to said crank, said contact assembly including a rotor movable between closed and open position and having an opposing first and second side faces, a contact arm having a first and second ends, said contact arm mounted for rotation to said rotor and, at least one contact mounted to said contact arm on one of said ends;

a handle lever attached for rotation to said side frame;

a spring attached between said toggle linkage spring spindle and said handle lever;

said crank first end is arranged such that a line between the center of said crank pivot and the center of said pin is perpendicular to a line of force created by said spring and transmitted through said lower link when said rotor is in the closed position.

8. The circuit breaker of claim 7 wherein:

said rotor assembly has a first orifice extending through said rotor first and second side faces.

9. The circuit breaker of claim 8 further comprising:

a drive shaft extending through said rotary contact assembly orifice and coupled to said crank second end.

10. The circuit breaker of claim 9 further comprising:

a second rotary contact assembly adjacent to and spaced apart from said first contact assembly within said base, said second rotary contact assembly having a first orifice extending therethrough;

said secondary contact assembly arranged such that said drive shaft extends through said second contact assembly first orifice.

11. The circuit breaker of claim 10 further comprising:

a third rotary contact assembly adjacent to and spaced apart from said first contact assembly opposite said second contact assembly within said base, said third contact assembly having a first orifice extending therethrough, said third contact assembly arranged such that said drive shaft extends through said third contact assembly first orifice.

12. The circuit breaker of claim 11 wherein:

said first contact assembly further comprises a rotor having a first and second opposite side faces, said first contact assembly first orifice extending through said first contact assembly first and second side faces.

13. The circuit breaker of claim 10 wherein:

said second contact assembly further comprises a rotor having an opposing first and second side faces, said second contact assembly first orifice extending through said second contact assembly first and second side faces.

14. The circuit breaker of claim 12 wherein:

said third contact assembly further comprises a rotor having an opposing first and second side faces, said third contact assembly first orifice extending through said third contact assembly first and second side faces.

* * * * *